US007036153B2

(12) United States Patent
Gibson et al.

(10) Patent No.: US 7,036,153 B2
(45) Date of Patent: May 2, 2006

(54) SEAT CUSHION WITH BUILT-IN LEG WARMER/PROTECTOR

(76) Inventors: Robert G. Gibson, 16 Sail Vista, Newport Coast, CA (US) 92657; George D. Heffner, 6133 County Rd. 316, Alvarado, TX (US) 76009; Terry E. Lovett, 4050 E. Chandler Ave., Santa Ana, CA (US) 92704

( * ) Notice: Subject to any disclaimer, the term of this patent is extended or adjusted under 35 U.S.C. 154(b) by 0 days.

(21) Appl. No.: 09/931,498

(22) Filed: Aug. 16, 2001

(65) Prior Publication Data

US 2003/0034674 A1 Feb. 20, 2003

(51) Int. Cl.
*A41D 13/00* (2006.01)
*A47C 16/00* (2006.01)
*A47C 31/00* (2006.01)

(52) U.S. Cl. ..... 2/69; 5/653; 297/219.1

(58) Field of Classification Search ..... 297/4, 297/219.1, 225, 228.11, 228.13, 218.1, 218.2; 2/69, 69.5 X, 72; 224/153, 575, 576, 577; 5/653 X, 417, 420; 296/77.1
See application file for complete search history.

(56) References Cited

U.S. PATENT DOCUMENTS 1,915,044 A * 6/1933 Anderson
2,146,400 A * 2/1939 Maker et al. ..... 2/69
2,230,689 A * 2/1941 Kemp
2,705,325 A * 4/1955 Bogenberger
3,228,034 A * 1/1966 Grove
3,329,971 A * 7/1967 Shelby ..... 2/69
3,443,066 A 5/1969 Weibel
3,580,633 A 5/1971 Du Priest
3,597,764 A 8/1971 Povey
3,665,517 A * 5/1972 Hyman
D258,482 S * 3/1981 Strock
4,507,805 A 4/1985 Calutoiu
4,843,662 A * 7/1989 Handelman
4,925,064 A * 5/1990 Comora
D377,573 S * 1/1997 Morgan
5,692,257 A * 12/1997 Albertieri
5,785,219 A * 7/1998 Kraft
5,946,729 A * 9/1999 Sakurai et al.
5,988,465 A * 11/1999 Vitale et al.
6,311,330 B1 * 11/2001 Rothman ..... 2/69
6,493,891 B1 * 12/2002 Livingston ..... 5/636

* cited by examiner

*Primary Examiner*—Peter M. Cuomo
*Assistant Examiner*—Sarah B. McPartlin
(74) *Attorney, Agent, or Firm*—James E. Walton

(57) ABSTRACT

A compact seat cushion built to be easily carried by a shoulder strap or built-in handle which has a padded top for sitting on and a bottom that is rugged and waterproof. The seat cushion unzips to separate the top and bottom into two separate parts. The leg-warmer/protector envelope attached to the bottom, unfolds from inside. The padded top is attached to the top of the leg-warmer/protector envelope. The leg-warmer/protector envelope has a side zipper to allow ease of ingress and egress and includes an extension zipper to lengthen the tube as desired. A built-in belt at the open end top of the leg-warmer/protector envelope allows a user to cinch it around his waist. The padded top which is fastened to the top of the open end of the envelope inserts into the envelope and is suspended at a level that allows it to be easily placed below the user's seat inside the leg-warmer/protector envelope.

10 Claims, 2 Drawing Sheets

SEAT CUSHION WITH BUILT-IN LEG WARMER/PROTECTOR

BACKGROUND OF THE INVENTION

1. Field of the Invention

The present invention relates generally to improvements in protective garments adapted for use by spectators at outdoor winter sports such as football games or the like, or by sportsmen such as duck hunters, for example.

2. Description of Prior Art

Those concerned with the development of protective clothing for spectators and hunters have long recognized the need for protecting the legs and feet of an individual even when such individuals are wearing warm boots and socks. Attempts in the past to provide some type of garment to keep the legs and feet warm have generally been in the form of a garment much like the lower half of a sleeping bag which has a bottom panel or flat area for receiving the feet of the wearer and an insulated peripheral panel enclosing the legs and lower body of the wearer, up to the waist, with a zipper-type closure provided on the front of the garment to enable the wearer to easily get into and out of the garment. Some of these garments have seats formed into the garment itself in the form of inflatable pillows.

None of these prior art devices however, provide a unitized structure for the purpose of providing a seat cushion that also functions as a carrying case. The present invention, on the other hand, provides a convenient carrying case by integrating the seat-cushion and leg-warmer/protector into a unitary structure.

SUMMARY OF THE INVENTION

A combination seat-cushion and leg-warmer having a top, a bottom and a fastener for connecting the top and bottom together to enclose a space, contains an envelope shaped leg-warmer/protector, closed at one end by the bottom and open at its other end. The top is attached to the open end of the envelope by a strap. The envelope receives the feet, legs and lower body, up to the waist, of a user. The strap is of sufficient length to allow the top to be placed so that the user can sit on the top, inside the envelope.

BRIEF DESCRIPTION OF THE DRAWINGS

The exact nature of this invention as well as its objects and advantages will be readily appreciated upon consideration of the following detailed description in conjunction with the accompanying drawings, in which like referenced numerals designate like parts throughout the figures thereof and wherein.

DESCRIPTION OF THE PREFERRED EMBODIMENT

Figure 1:
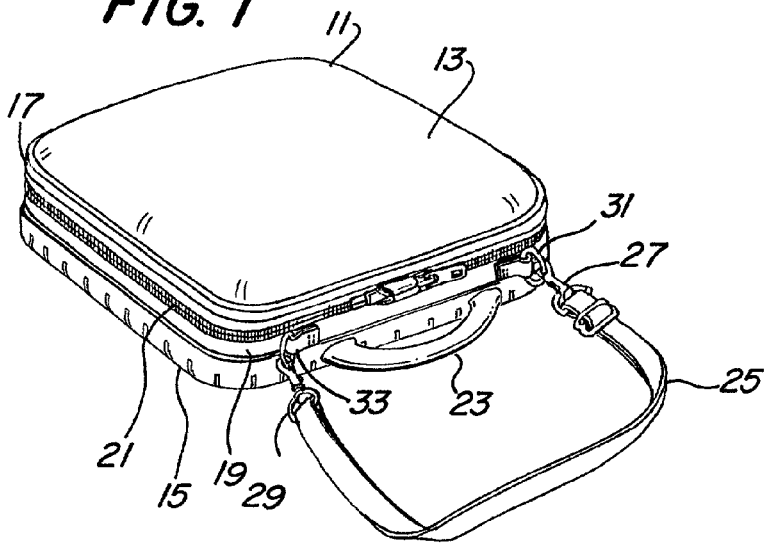
FIG. 1 is a perspective view, from the top, of a preferred embodiment of the invention.

FIG. 1 illustrates the cushion form of the seat-cushion with built-in leg-warmer/protector 11 of the present invention. The cushion 11 comprises a top 13 preferably substantially rectangular in shape, of a convenient size, or, in the alternative, an oval or circular shape may also be used. The top 13 is preferably made of a tear-proof material. The cushion 11 also has a bottom 15, as more clearly illustrated in FIG. 2, which is preferably made out of a molded vinyl or rubberized material that is not only tear-proof and waterproof but also highly abrasion resistant. The top 13 and bottom 15 are connected together by a side skirt 17 attached to a top 13 and a side-skirt 19 attached to the bottom 15 which has a fastener such as a VELCRO™ strap or a zipper 21, or equivalent attached thereto and extending completely around the perimeter of cushion 11.

A handle 23 is attached to the bottom 15 of cushion 11. The handle 23 is preferably made out of the same material as the bottom 15, that is, a vinyl or rubberized material, and may be molded as a single piece with the bottom 15. Also attached to the bottom 15 is a pair of loops 31, 33 to which a strap 25 having latches 27, 29, at either end, are connected. Strap 25 is preferably a shoulder strap for cushion 11.

Figure 2:
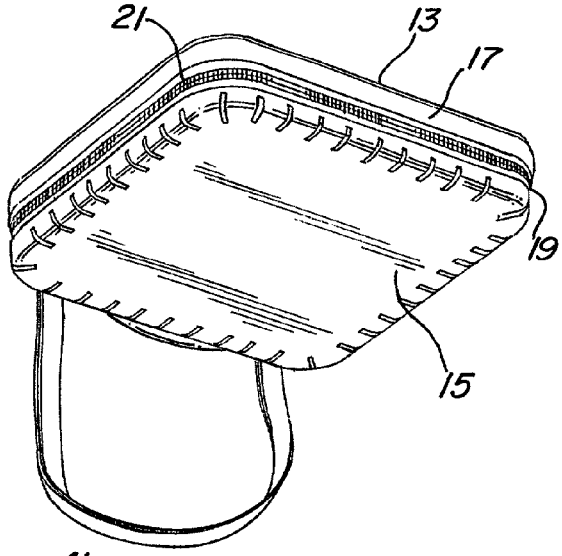
FIG. 2 is a perspective view, from the bottom, of a preferred embodiment of the invention.
Figure 3:
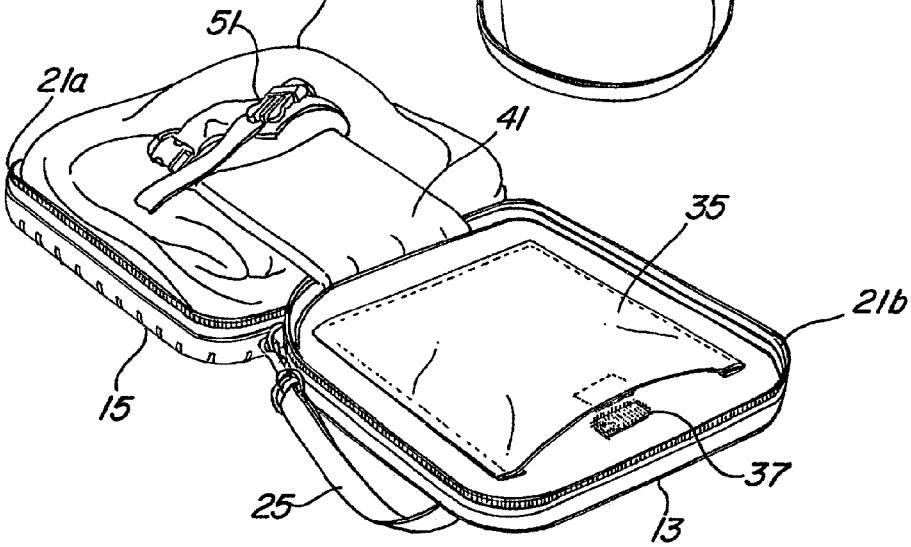
FIG. 3 is a perspective view of the preferred embodiment of the invention with the top and bottom unzipped.

As illustrated in FIGS. 1 and 2, seat cushion 11 is simply that, a cushion upon which a user may sit to watch a sporting event or to wait for game. If inclement weather ensues, the user simply unzips zipper 21 having zipper half 21*b* attached to top 13 and zipper half 21*a* attached to bottom 15, separating the top 13 and the bottom 15 into its two separate halves, as illustrated in FIG. 3, to reveal the inside which contains an envelope shaped leg-warmer/protector 39. The top 13 is attached to the envelope-shaped protector 39 by way of a strap 41.

Figure 4:
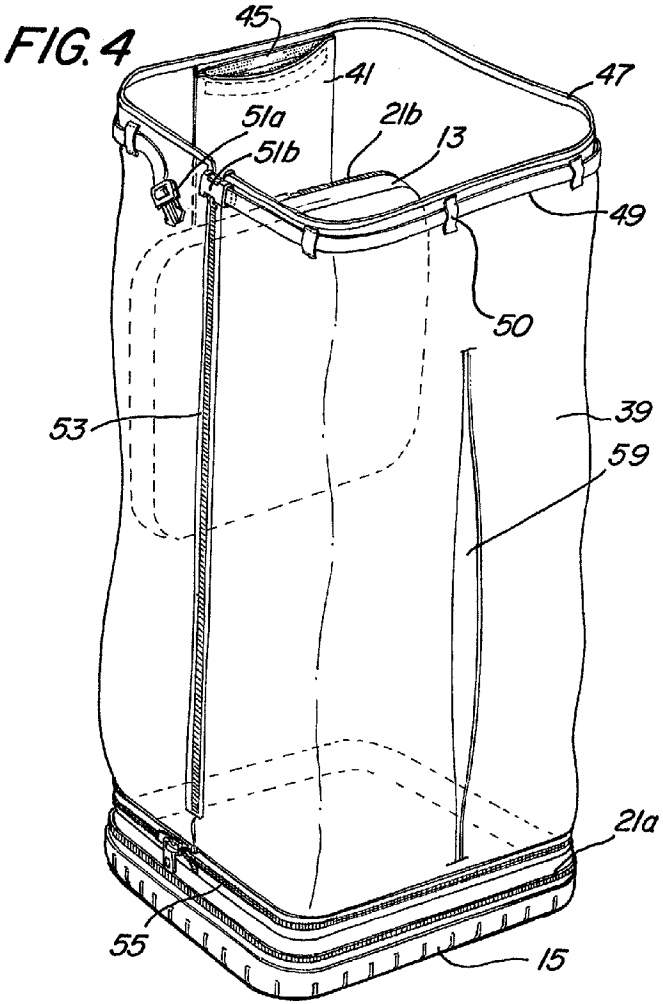
FIG. 4 is a perspective view of the preferred embodiment of the invention with the seat-cushion, leg-warmer/protector combination unfolded.

Once unzipped, the envelope-shaped leg-warmer/protector 39 is pulled out of the bottom 15 portion of pad 11 to its full extended length, as shown in FIG. 4, leaving the bottom end of the envelope-shaped leg-warmer/protector 39 attached to and enclosed by the bottom 15, and the top end completely open. Close to the upper edge 47 at the open end, a cinch strap 49 with mating buckle ends 51*a* and 51*b* is attached by belt loops 50, as shown, or by any other equivalent convenient means, to the leg protector tube 39.

Figure 5:
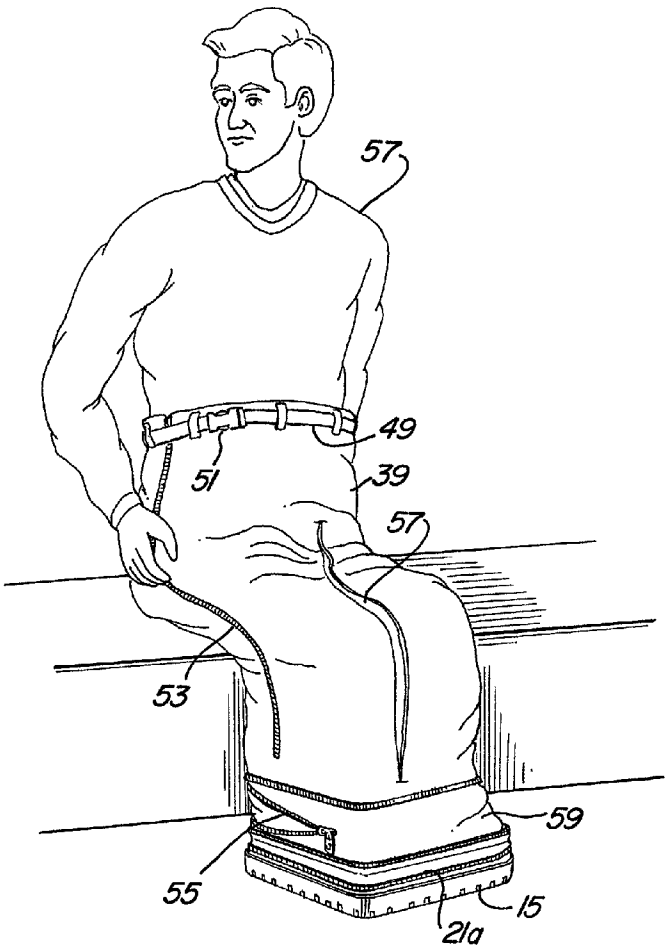
FIG. 5 is a perspective view of the preferred embodiment of the invention as used by a spectator or hunter.

The front of the envelope-shaped leg-warmer/protector 39 has a pleat 59 to allow expandability of its width and increase freedom of movement inside the envelope 39. A zipper 53 in one side running along the length of the envelope 39, allows for easy ingress and egress by a user. Another zipper 55 at the bottom of the envelope 39 allows for expanding the length of the envelope 39 by permitting an additional length of material 59 to be added to the envelope 39. The top 13 of the cushion 11 which is attached to the top 47 of envelope 39 by strap 41 is dropped into envelope 39. Strap 41 may be wide enough to include a pouch having an opening at its top 45 which can be closed by VELCRO™ fastening means, or some other equivalent means. The strap 41 is at a length that conveniently locates the top 13 so that it is easily placed below the bottom of a user 57 when in a sitting position, as shown in FIG. 5. The top 13, as shown in FIG. 3, also has a pouch 35 on its underside, with a convenient VELCRO™ fastener or other equivalent fastening means 37, for closing the pouch. The pouch 35 may be used for carrying a variety of material. The top 13 also has padded material, such as foam or quilting, or any equivalent material located within it, to cushion the seat of the user when the leg-warmer/protector envelope 39 is being utilized.

As shown in FIG. 5, the user 57 steps into the envelope 39, zips up the zipper 53, and cinches the belt 49 using cinching clasps 51 to snugly draw the open end 47 around his waist to prevent the air from circulating down into the interior of envelope 39.

The material of envelope 39 is preferably a tear-proof, soft luggage type material of sufficient weight to withstand extended years of use on hard surfaces. The interior of envelope 39 may have additional insulating layers (not shown) laminated thereto for additional strength and warmth without adding bulk and weight. Such additional layers may be attached by glue or quilting, for example.

What is claimed is:

1. A combination seat cushion and leg warmer, comprising:

a water-proof bottom having a base portion and an upright skirt portion;

a collapsible envelope portion connected at one end to the bottom, the envelope portion including at least one expandable pleat adjacent the legs;

a seat cushion connected to an opposing end of the envelope portion, the seat cushion being movable relative to the envelope portion;

a means for releasably connecting the seat cushion to the skirt portion;

the wherein the combination seat cushion and leg warmer is operable between an open mode in which the envelope portion is expanded to receive the legs of a user; and a closed mode in which the envelope is collapsed and enclosed within a volume formed by the base portion, the skirt portion, and the cushion.

2. The combination seat cushion and leg warmer according to claim 1, wherein the water-proof bottom is formed of a molded rubber material.

3. The combination seat cushion and leg warmer according to claim 1, wherein the seat cushion is connected to the opposing end of the envelope portion by a wide tether.

4. The combination seat cushion and leg warmer according to claim 3, further comprising:

a storage pouch formed in the wide tether.

5. The combination seat cushion and leg warmer according to claim 1, wherein the means for releasably connecting the seat cushion to the skirt portion is a zipper.

6. The combination seat cushion and leg warmer according to claim 1, wherein the collapsible envelope portion is made of an insulating material.

7. The combination seat cushion and leg warmer according to claim 1, further comprising:

a shoulder strap.

8. The combination seat cushion and leg warmer according to claim 1, further comprising:

a carrying handle.

9. The combination seat cushion and leg warmer according to claim 1, further comprising:

an entrance slit.

10. The combination seat cushion and leg warmer according to claim 9, wherein the entrance slit is sealed by a zipper.

* * * * *